US010995570B2

(12) United States Patent
Ly et al.

(10) Patent No.: US 10,995,570 B2
(45) Date of Patent: May 4, 2021

(54) TOOL JOINT FINDING APPARATUS AND METHOD

(71) Applicant: Weatherford Technology Holdings, LLC, Houston, TX (US)

(72) Inventors: Lizabeth J. Ly, Katy, TX (US); Thomas H. Koithan, Houston, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 0 days.

(21) Appl. No.: 15/789,262

(22) Filed: Oct. 20, 2017

(65) Prior Publication Data

US 2019/0119996 A1 Apr. 25, 2019

(51) Int. Cl.
*E21B 19/16* (2006.01)
*E21B 47/12* (2012.01)

(52) U.S. Cl.
CPC ..... *E21B 19/165* (2013.01); *E21B 19/161* (2013.01); *E21B 47/12* (2013.01)

(58) Field of Classification Search
CPC ..... E21B 19/00; E21B 19/02; E21B 19/04; E21B 19/06; E21B 19/07; E21B 19/14; E21B 44/00
See application file for complete search history.

(56) References Cited

U.S. PATENT DOCUMENTS 6,752,044 B2 6/2004 Hawkins, III
6,965,230 B2 11/2005 Rogers et al.
7,815,093 B2 10/2010 Hees
8,065,937 B2 11/2011 Halse
9,322,950 B2 4/2016 Gustavsson et al.
9,464,492 B2 * 10/2016 Austefjord ..... B66C 13/02
2008/0282847 A1 11/2008 Halse
2008/0307930 A1 12/2008 Veverica et al.
2010/0326659 A1 * 12/2010 Schultz ..... E21B 29/02 166/297
2012/0026322 A1 * 2/2012 Malka ..... G01C 11/02 348/142
2013/0008644 A1 1/2013 Huseman et al.
2013/0271576 A1 10/2013 Ellis
(Continued)

FOREIGN PATENT DOCUMENTS

EP 2458135 A2 5/2012
EP 2666955 A2 11/2013
(Continued)

OTHER PUBLICATIONS

EPO Extended European Search Report dated Mar. 7, 2019, for European Application No. 18200542.1.
(Continued)

*Primary Examiner* — Tara Schimpf
(74) *Attorney, Agent, or Firm* — Patterson + Sheridan, LLP

(57) ABSTRACT

An apparatus for identifying a tool joint connection is disclosed comprising a scanning system configured to scan an exterior of a drill string, at least one distance measuring sensor mounted to a movable platform and a computer connected to the scanning system and the at least one distance measuring sensor, wherein the computer is configured to receive data from a scanning of the exterior of the drill string and compare the data from the scanning to a reference to determine a presence of the tool joint connection.

18 Claims, 12 Drawing Sheets

(56) References Cited

U.S. PATENT DOCUMENTS

| | | | | |
|---|---|---|---|---|
| 2015/0204182 | A1 | 7/2015 | Andarawis et al. | |
| 2016/0194950 | A1* | 7/2016 | Zheng | E21B 17/006 73/152.04 |
| 2016/0312602 | A1 | 10/2016 | Carlson et al. | |
| 2017/0081954 | A1 | 3/2017 | Dewald et al. | |
| 2017/0314369 | A1* | 11/2017 | Rosano | F16P 3/142 |

FOREIGN PATENT DOCUMENTS

| | | | |
|---|---|---|---|
| WO | 2007061345 | A1 | 5/2007 |
| WO | 2016100693 | A1 | 6/2016 |

OTHER PUBLICATIONS

EPO Office Action dated Nov. 29, 2019, for European Patent Application No. 18200542.1.
EPO Office Action dated Apr. 6, 2020, for European Patent Application No. 18200542.1.

* cited by examiner 170
102
104

113
175
102
114
116
104

118
124
120
122

126

TOOL JOINT FINDING APPARATUS AND METHOD

FIELD OF THE INVENTION

Aspects of the disclosure relate to drilling technologies. More specifically, aspects of the disclosure relate to apparatus and methods for finding a tool joint of a drill string.

BACKGROUND INFORMATION

Drilling for hydrocarbons in the energy industry requires many specialized tools to allow for production of the hydrocarbons sought. The specialized tools allow for drilling to proceed at a rapid pace. The rapid pace is necessary as the costs of production for wells can be exceedingly expensive during the drilling process.

Drilling efficiency is most commonly determined by the rate of penetration (ROP) of the drill string into the geological stratum. Industry efforts to increase the ROP to levels never achieved have been continuing. In certain economic conditions, for example, if the price of a hypothetical barrel of oil is low, some reserves may not be able to be economically recovered if the ROP is below a given threshold. To open up more potential hydrocarbon fields to exploration or to drill in established fields where the economics are uncertain, increased ROP can allow field owners to develop the field at competitive costs allowing greater profits for drillers and field managers.

As technology increases, there is a desire to automate certain functions of the drilling process in order to remove inefficiencies. Ideally, if the entire drilling process can be automated, then many inefficiencies may be removed and an optimum economic output can be achieved. Such automated drilling functions, however, are not achievable with present day technology. Workers are used to performing many tasks that need to be achieved because robotic assemblies cannot be designed to address all of the different scenarios that drill rig operators encounter on a daily basis.

One of the most basic tasks that workers perform on drilling rigs is creating an ever longer length of pipe, with a drill bit at the end, to remove material from the bottom of a wellbore. As the drilling progress proceeds, more pipe is added to the overall length of pipe, called a drill string. Each successive length of pipe that is added to the drill string must be securely fastened to the existing drill string such that the pipe does not "back off" or become loose in the drill string. As a result, "making up" or establishing the connection between a drill pipe and the entire drill string is extremely important to the overall drilling process.

Hydraulic tools, called tongs, can torque the tool joint to a specific torque level established by the well engineer, but to date, the establishment of this tool joint is performed by visual identification of the ends of the pipe. The establishment of the tool joint, in fact, is governed by the geometry of the pipe, including the overall pipe diameter, the pipe thickness, the drilling angle, the pipe material and other factors. The receiving end at the end of the drill string, called the box, accepts a drill pipe end, called a pin. Each of the box and the pin have corresponding connective arrangements, such as a given number of threads per inch for the tool joint. The number of threads per inch, and the torque of the tool joint, establishes the strength of the connection.

As can be readily seen, the environment that the drill rig encounters can be very challenging. Drill rigs must be able to withstand extremes in temperature and conditions to recover the hydrocarbons. The environments can range from sand and granular environments to mud, clay and silt environments. These environments each play important roles in the drilling functions. Environments are often encountered that cake mud, silt or clay over the surface of the drill string. This coating effect can hide the established tool joint or can impede the establishment of the tool joint during the torque process.

There is a need, therefore, to increase the speed at which the drilling process can proceed to increase the economy of the drilling process.

There is a further need to eliminate inefficiencies in the drilling process to allow marginal fields to be economically recovered.

There is a still further need to provide an arrangement to find a tool joint and a method to address a tool joint in various climates and environments, in a safe and effective manner.

SUMMARY

So that the manner in which the above recited features of the present disclosure can be understood in detail, a more particular description of the disclosure, briefly summarized below, may be had by reference to embodiments, some of which are illustrated in the appended drawings. It is to be noted that the appended drawings illustrate only typical embodiments of this disclosure and are therefore not to be considered limiting of its scope, for the disclosure may admit to other equally effective embodiments without specific recitation. Accordingly, the following summary provides just a few aspects of the description and should not be used to limit the described embodiments to a single concept.

In one non-limiting embodiment, a method for identifying a feature of a drill string is disclosed comprising positioning a scanning system along the drill string, the scanning system having at least one arrangement configured to scan the drill string, scanning an exterior of the drill string with the scanning system to obtain scan data, transmitting the scan data to a computer, analyzing the scan data with the computer by comparing the scan data with a training data set and producing an output from the computer to a user indicating where a tool joint location in the drill string is present.

In another non-limiting embodiment, an apparatus for identifying a tool joint connection, is disclosed comprising a scanning system configured to scan an exterior of a drill string, at least one distance measuring sensor mounted to a movable platform and a computer connected to the scanning system and the at least one distance measuring sensor, wherein the computer is configured to receive data from a scanning of the exterior of the drill string and compare the data from the scanning to a reference to determine a presence of the tool joint connection.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

To facilitate understanding, identical reference numerals have been used, where possible, to designate identical elements that are common to the figures. It is contemplated that elements disclosed in one embodiment may be beneficially utilized on other embodiments without specific recitation.

DETAILED DESCRIPTION

In the following description, reference is made to embodiments of the disclosure. It should be understood, however, that the disclosure is not limited to specific described embodiments. Instead, any combination of the following features and elements, whether related to different embodiments or not, is contemplated to implement and practice the disclosure. Furthermore, although embodiments of the disclosure may achieve advantages over other possible solutions and/or over the prior art, whether or not a particular advantage is achieved by a given embodiment is not limiting of the disclosure. Thus, the following aspects, features, embodiments and advantages are merely illustrative and are not considered elements or limitations of the appended claims except where explicitly recited in a claim. Likewise, reference to "the disclosure" shall not be construed as a generalization of an inventive subject matter disclosed herein and shall not be considered to be an element or limitation of the appended claims except where explicitly recited in a claim.

Some embodiments will now be described with reference to the figures. Like elements in the various figures will be referenced with like numbers for consistency. In the following description, numerous details are set forth to provide an understanding of various embodiments and/or features. It will be understood, however, by those skilled in the art that some embodiments may be practiced without many of these details and that numerous variations or modifications from the described embodiments are possible. As used herein, the terms "above" and "below", "up" and "down", "upper" and "lower", "upwardly" and "downwardly", and other like terms indicating relative positions above or below a given point or element are used in this description to more clearly describe certain embodiments.

Figure 1A:
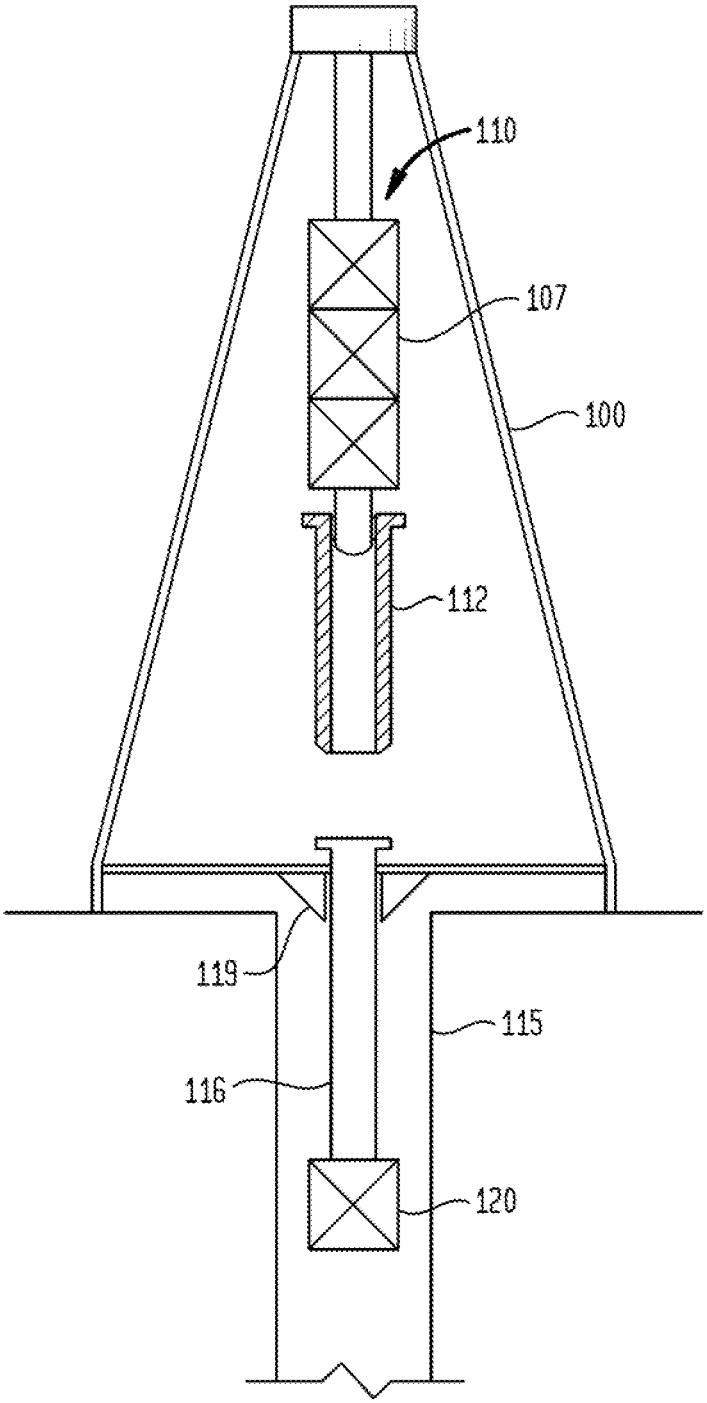
FIG. 1A (PRIOR ART)
FIG. 1A is a diagram of a top drive assembly that is used to place drill strings in geological strata.

Referring to FIG. 1A, in conventional drilling, drill pipe 112 is added to a drill string in a manual operation performed by workers. Such activities are necessary to increase the length of the drill string 116 in order to reach drilling depth objectives. As drilling progresses, the drill bit 120 at the bottom of the drill string 116 progresses into the geological stratum. To establish a connection between the existing drill string and a piece of pipe to be newly added, the workers use a piece of equipment known as a tong assembly 1000, illustrated in FIG. 10. The tong assembly 1000 includes a power tong 1022 and a back up tong 1026. The power tong 1022 is placed at a specific position of the pin section (one axial end of the drill pipe 112). The back-up tong 1026 is then placed at a specific position of the box end of the drill string 116. Once the power tong 1022 and the back-up tong 1026 are correctly positioned, the connection between the box and pin can be established (torqued). In a like manner, the connection between the pipe end section of the drill string and the remainder of the drillstring 116 may be or broken (untorqued). The drill string 116 is supported within the wellbore 115 by a set of slips 119. Rotary motion of the drill string 116 is achieved by a top drive 107 that is supported by an arrangement 110 connected to a derrick 100.

When pipe is removed from the drill string, known as a "trip", breaking the connection is generally more challenging. As can be understood, when a drill string 116 is being inserted into a wellbore, the drill string 116 is relatively clean. When a drill string 116 is being removed from a geological stratum, however, the connections of the drill string may be more difficult to identify and break because of contaminants on the exterior of the drill string 116.

Figures 1B, 1C, 1D, 1E:
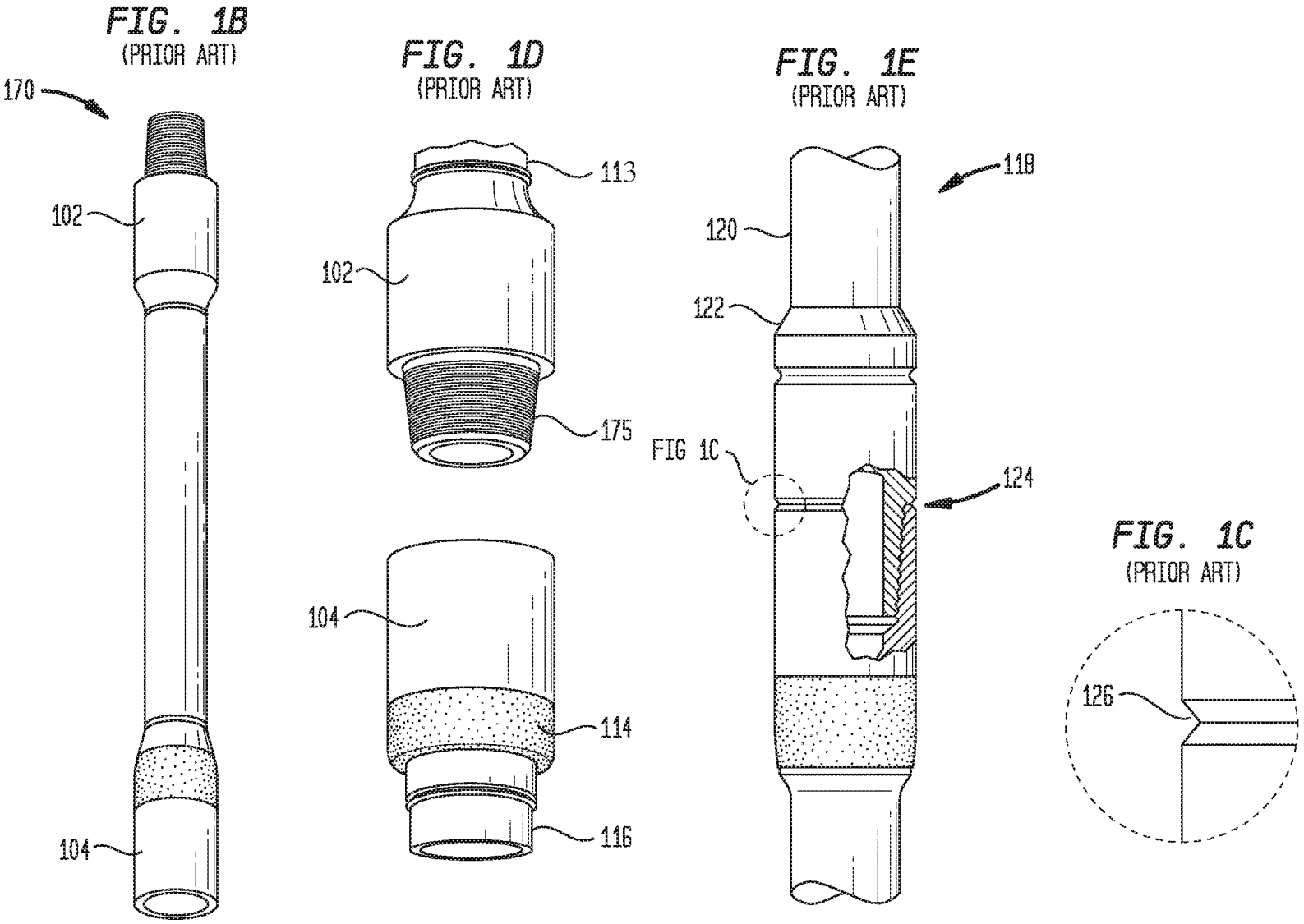
FIG. 1B (PRIOR ART)
FIG. 1D (PRIOR ART)
FIG. 1E (PRIOR ART)
FIG. 1C (PRIOR ART)
FIGS. 1B, 1C, and 1E are a diagrams of prior art box and pin connections for a drill string.
FIG. 1D is a diagram of a separated box and pin connection.

Aspects provided in the present disclosure allow for make-up (establishing) and break-out (disconnecting) of drill string connections through an automated process compared to manual processes with conventional drilling. The automated system has several advantages compared to conventional drilling methods. The automated system can quickly and efficiently identify both locations of tool joints, such as a pipe joint, as well as the type of tool joint connection. This allows for operators to successfully untorque a tool joint connection based upon parameters such as the diameter, gauge, thread type and materials that are used in the connection. As will be apparent according to an example embodiment, differing tool joints will require different amounts of untorquing strength. Once a successful identification of the type of tool joint connection is performed, the data may be provided to the computers controlling the tong and back-up tong, allowing for proper untorquing without overstressing the drill string materials. Referring to FIG. 1B, drilling components are illustrated that make up a drill string connection. At the left most portion of FIG. 1B, a pin 102 and a box 104 of a threaded connection are illustrated for a single pipe 170.

The center most portion of FIG. 1D, a box 104 and a pin 102 are illustrated at different ends of two pipes. The pin 102 may have a leading edge threaded connection 175 that screws into the box 104 of the drill string. The configuration may have an area of hardbanding 113 that provides for more rugged handling of the pin 102. In areas of such hardbanding 113, tools, such as power tongs 1022 and back-up tongs 1026, may be placed in these areas to prevent damage of the drill string during torquing and untorquing procedures. In this embodiment, moreover, the box 104 may also have a neck area 114 that provides for a transition from the box 104 to the nominal diameter of the drill string 116. The neck area 114 provides an increased section modulus of material to allow the joint to withstand bending and sheer forces that the joint will be subjected to.

The right most arrangement of FIG. 1E, a tool joint 118 may have a drill pipe tube 120, a pin taper 122, a tool joint connection line 124 as well as a chamfer area 126 along the tool joint connection line 124. The separation of the joint for the top and bottom sections of the tool joint are found, for example, by noting the chamfer 126 position in FIG. 1C.

Figures 2A, 2B, 2C:
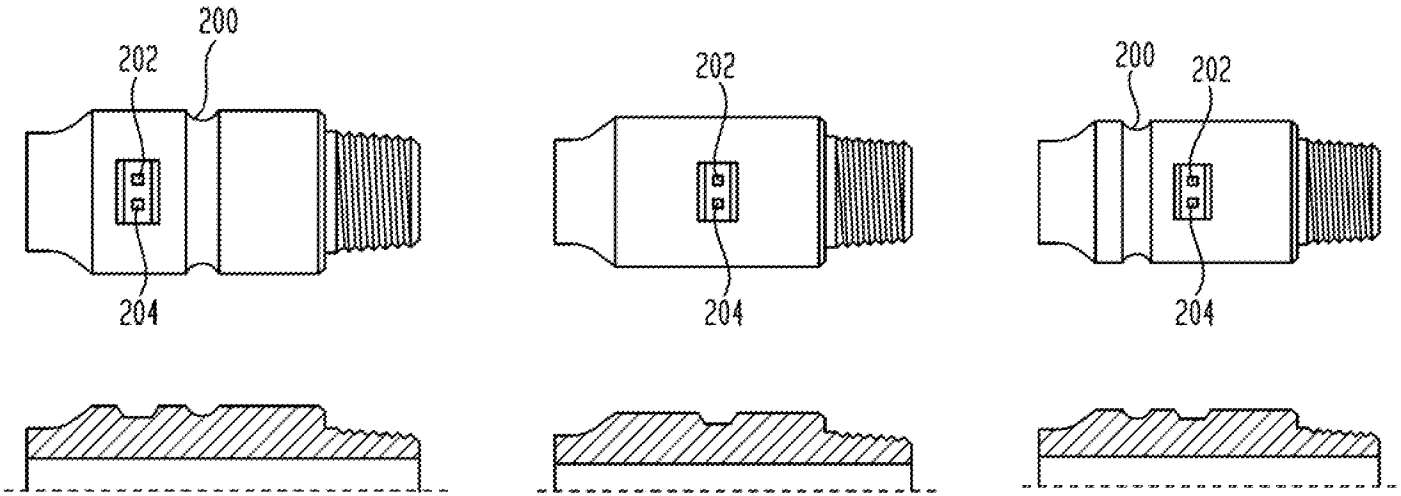
FIG. 2A (PRIOR ART)
FIG. 2B (PRIOR ART)
FIG. 2C (PRIOR ART)
FIGS. 2A, 2B and 2C are cross sections of various prior art types of drill pipe.

Referring to FIGS. 2A-2C, in some instances, a tool joint may have an additional groove 200 on the tool joint pin area. This additional groove 200 identifies the type of drill pipe that is used, such as a high strength drill pipe, heavy weight drill pipe or heavy weight high strength drill pipe. The groove 200 may have a larger width than a tool joint connection line that consists of chamfers on the pin and the box. The groove 200, therefore, can be readily identified by visual inspection. In some embodiments, additional markings or identifiers may be placed on the pin. A pipe weight code 202 and a pipe grade code 204 may be located on the pin to identify the component.

Adding to the difficulty of identifying components, the connection line between the box and the pin of the tool joint may be covered with not only mud but also pipe dope that is used by workers to establish the piping connection between the pin and the box. Usually, if the tool joint is covered in mud, partially or completely, the tool joint connection line's indentation is apparent under visual identification. When pipe dope appears in a tool joint connection line, such as when pipe dope exits out when the two drill pipes are connected, it can be concluded that the tool joint connection line is where the dope exits. In occurrences, however, when mud or dope is hindering the appearance of the tool joint connection line, an infrared sensor, laser or ultrasonics may be used to detect the location of the tool joint connection line. An automated, or even autonomous, process to carry out such a recognition requires a more complex approach in order to detect the connection line reliably. An example of such a process is described below.

An automated process to detect a tool joint connection line in a reliable manner can include use of several sensors, which include but are not limited to infrared (IR) lasers, cameras, infrared cameras, thermal cameras, ultrasonics and LIDAR. The sensors or a combination of these sensors, are configured to distinguish the target (i.e., the tool joint connection line), regardless of environmental factors, such as poor illumination, rain, or snow. In one non-limiting embodiment, as provided in FIG. 6, the scanning system 600 may be attached to a movable platform 603 that allows a sensor in the system 600 to move and/or angle towards its specific target and to calculate and/or measure the position and/or angle. The movable platform 603 may be a robotic arm, manually movable arm or other similar type of arrangement. The scanning system 600 may also be located on the power tong 1022, described in FIG. 10, or back-up tong 1026, as applicable. The scanning system 600 may scan the exterior of the tool joint area 602 and receive data from the scanned area. The data is then processed, for example by a computer, and the computer may output the resultant data to a control system 999, whether it is a separate machine or the same machine. The control system may also be connected to the scanning system to move the scanning system or the tool that the system is connected to in order to allow for measurement of the data. As a non-limiting example, if a scanning system 600 is too far from the exterior of the tool joint 602 to take an appropriate reading, the control system 999, may move the movable platform 603 to an alternative location in an effort to retain better data. In an example embodiment, two scanning systems will be used to distinguish the distance from a target and could be at a different height (i.e., in the Y plane) but on the same X and Z plane.

Figure 3:
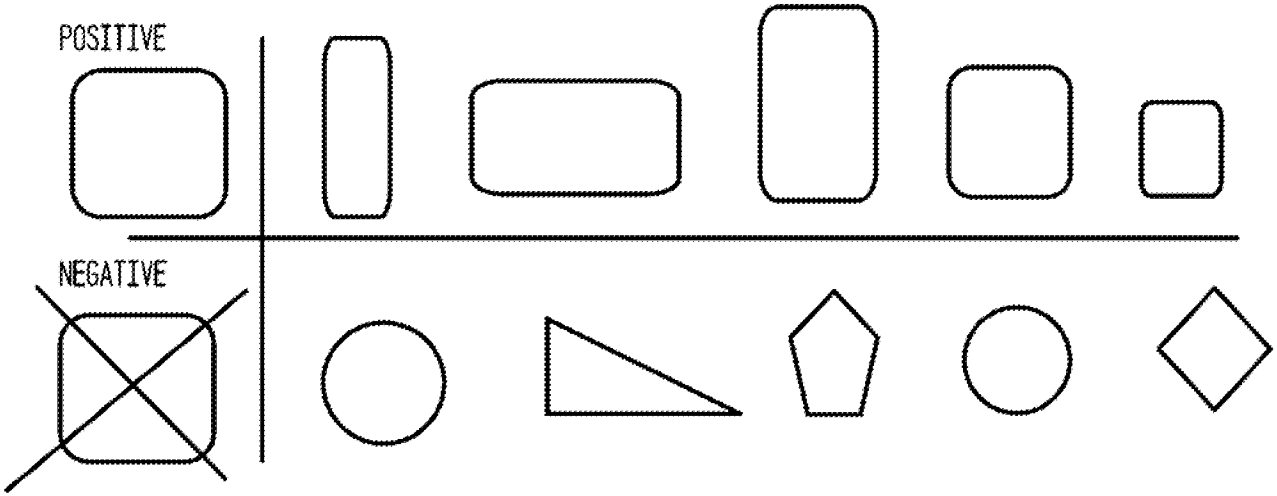
FIG. 3 is a diagram using shapes to demonstrate a difference between positive data sets and negative data sets.

Referring to FIG. 3, to aid in detection of a tool joint connection line, the scanning system 600 is calibrated such that identification of tool joint connection lines occurs on a regular and error free basis. Calibration may utilize several training data sets and learning algorithms. In one non-limiting example embodiment, a training set may consist of data, of 2D images of the tool joints and the tool joint components (positive) or not any images of the tool joints and the tool joint components (negative). The scanning system, through analysis in the computer, can compare the training sets to actually received data and determine how much correlation is present between the two sets of data. If correlation is above a specific threshold, then the analysis shows that the tool joint connection line is present at a specific location or that the tool joint has specific characteristics, such as certain lengths, diameters, etc.

Several training data sets of the tool joint box, the tool joint pin, the tool joint, and the tool joint connection line may be required to create a large identification database which can identify several configurations. Training sets may also be a combination of data sets mentioned above. As will be understood, less calibration is needed if the number of possible configurations to identify in a drill string is maintained at a low number.

Possible algorithms to detect the tool joint and the tool joint connection line may be based on Principle Component Analysis (PCA), Support Vector Machines (SVM), Viola & Jones, and k-nearest neighbors analysis techniques. These analysis techniques can be augmented wherein the techniques may be combined with a filter, such as Canny, Sobel, Prewitt, Robert's Cross, Histogram of Oriented Gradients (HOG), Scale-Invariant Feature Transform (SIFT), and Speeded Up Robust Features (SURF) as non-limiting embodiments.

Once the scanning system 600 has been trained with appropriate training sets of data, the accuracy of the system may be verified in a testing stage. The testing stage uses images called "mean images" developed during the training stage and compares these mean images to real time images that are presented to the system. During this testing stage, the system will detect tool joint connection lines by looking for similarities of the tool joint, tool joint pin, tool joint box, tool joint connection line, and other components. In certain example embodiments, the testing stage may use size as a distinguishing feature. In other example embodiments, size may not be used as a distinguishing feature.

Figure 4:
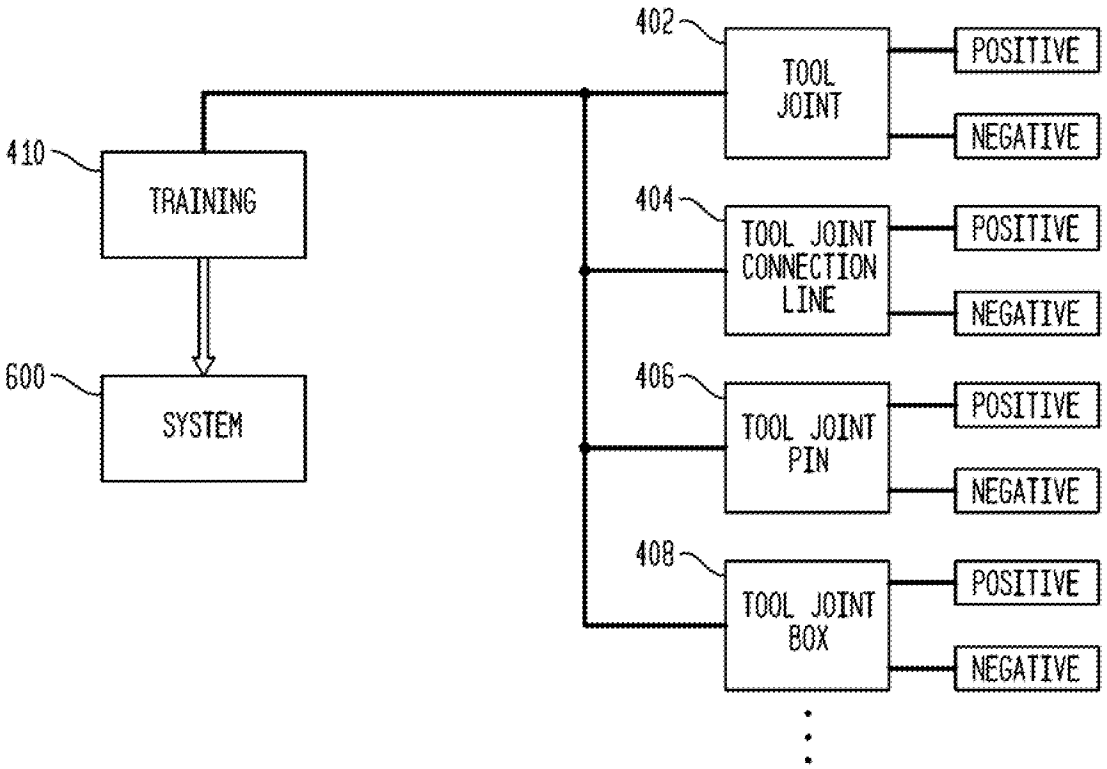
FIG. 4 is a diagram of a training stage in one example embodiment of the disclosure.

Referring to the example in FIG. 4, these concepts can be applied to detect a casing tool joint, with several training sets that consist of the casing and the casing's components. Casing, different than a drill string, also has a joint that may be established through a torque procedure. This torque procedure may use, for example, power tongs for gripping and torquing to specified values. The methods and arrangements described herein, therefore, are not limited to drill strings but are also applicable to sections of casing and other wellbore tubulars. As provided in FIG. 4, positive and negative data sets are provided for each of the tool joint 402, tool joint connection line 404, tool joint pin 406 and tool joint box 408. This data is provided as data sets to the computer to aid in training 410 for analysis by the scanning system 600.

Figure 5:
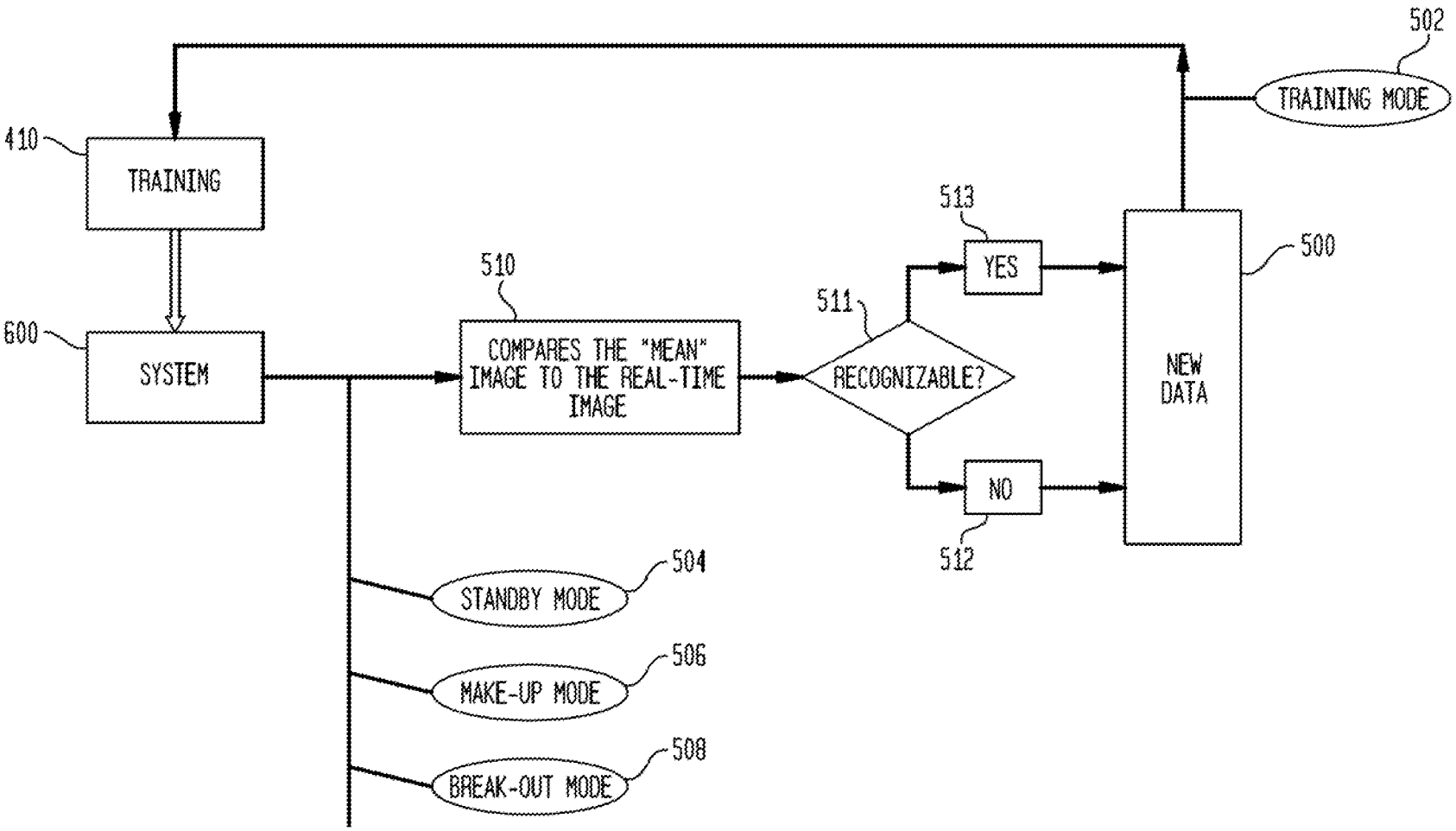
FIG. 5 is a diagram of a testing stage of one example embodiment of the disclosure.

Referring to FIG. 5, during the testing stage, the scanning system 600 may also collect new data 500 such as images in separate data sets from testing images that may be used as negative data for all the other training data sets, so that the system can increase the level of accuracy in detecting the tool joint, tool joint box, tool joint pin, and tool joint connection line. The positive data will be separated into its corresponding positive training data sets, separate from negative data sets. As a non-limiting example embodiment, therefore, the tool joint pin training data set may have two different types of data. In this embodiment, the positive data will only have images of the tool joint pin, whereas the negative data will have images that do not consist of the tool joint pin, such as casing, rig, tool joint box, tool joint connection line, tong handler, etc. The system 600 may integrate the new data sets on command in the training mode 502. After completion of the training mode 502, the system 600 may be able to identify the tool joint, tool joint box, tool joint pin, tool joint connection line and/or that there are none of these targets present.

An input will determine whether a make-up or break-out of the drill pipes is desired. If the drill pipes are not present and the system is not being used at the moment, the computer will either receive a standby command 504, during which the system is waiting for a make-up 506 or break-out command 508, power down or shut down command for the system, or training command. In short, there will be at least 5 different types of potential outcomes for the analysis, such as tool joint, tool joint box, tool joint pin, tool joint connection line, or no tool joint targets are present, and at least 5 different modes, such as standby mode, make-up mode, break-out mode, shut-down mode, and training mode. During standby mode, make-up mode, and break-out mode, new data may be collected.

Figure 6:
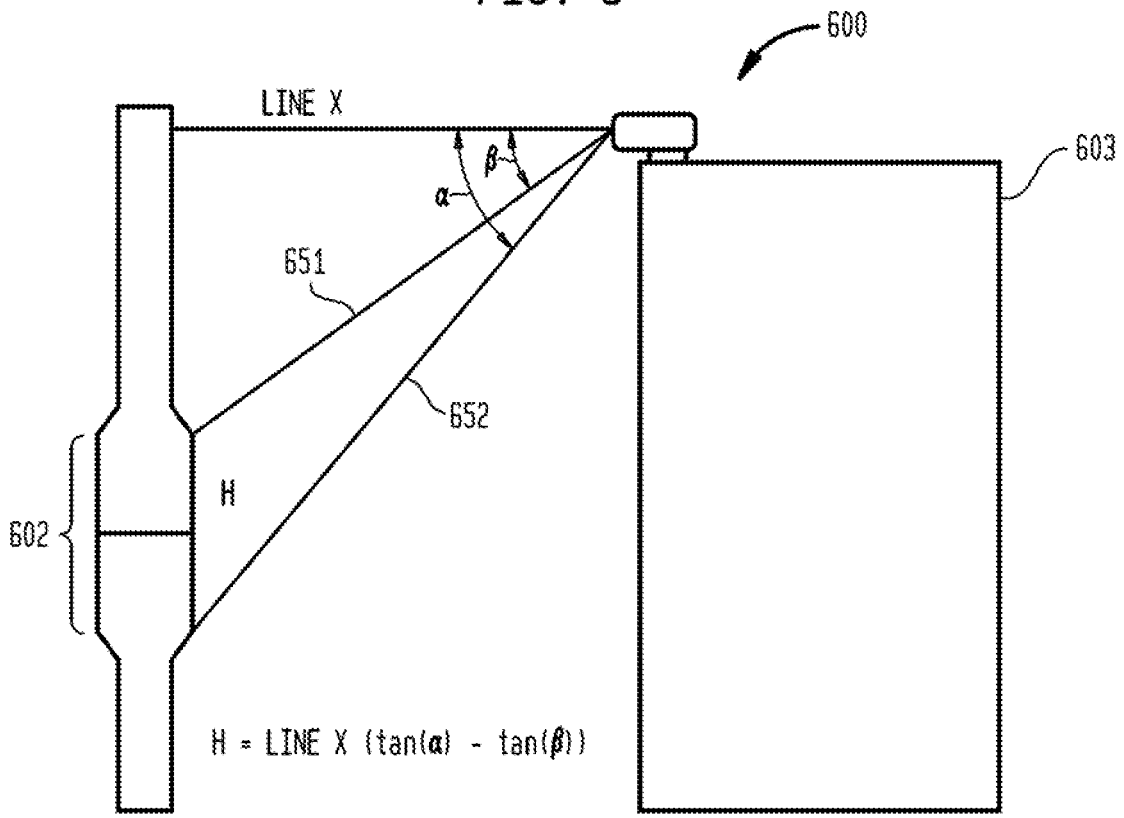
FIG. 6 is a diagram of a geometry to calculate a height of a tool joint.

In one non-limiting embodiment, in an example method, a break-out mode 508 will be described first followed by the make-up mode 506. The break-out mode 508 is applicable to disassembling the drill string or casing string. The make-up mode 506 is applicable to assembling the drill string or casing string. When the operator turns on the system 600, the system 600 may automatically enter "standby mode"; in this mode, the system is ready to detect targets on a surface and collect new data. The operator may choose a mode, in this case, the break-out mode 508, i.e., disassembly. The system 600 visually scans the surface of the drill string using a camera, as a non-limiting example and, receives the incoming data, and compares this data to a "tool joint mean" image 510, which is calculated by algorithm from both positive and negative data set. Through this analysis, the system 600 starts detecting the overall tool joint 602. If the system 600 attempts to recognize the data 511 and determines that a tool joint is not present 512, the system 600 will try again and if the system 600 fails to find a tool joint again, the system 600 may send a feedback to the operator (not shown) notifying that a tool joint is not present and the system 600 will enter a standby mode 504. If the system, at 511 recognizes the presence of a tool joint 513 then further scans can be conducted at 500, if desired. As provided in the drawing, the loop can be completed, in one non-limiting example embodiment. Referring to FIG. 6, if the system 600 determines that a tool joint is present at 602, the sensor in the system 600 will be able to detect the tool joint and the sensor in the system 600 send a feedback to the system 600 to activate a distance measuring device, such as a laser 1010 (See FIG. 10), to measure a distance from the power tong's carrier 1040 to the drill pipe 112. At the same time, the scanning system 600 calculates the curvature of the tool joint to estimate the angle of the scanning system 600 to the top and bottom of the tool joint, angles .alpha. and .beta.. The system 600 may then use geometry to approximate the length of the tool joint, as represented by H. Line X is measured by the scanning system 600. The scanning system 600 is able to detect the start and the end of the tool joint 602. Also, a first reference line 651 is taken between the pin and the hardbanding, and a second reference line 652 is taken between the box and wield neck. Depending on the sensor's position, the curvature of the connection line could determine the angle of the sensor 600 in regards to the two reference lines 651, 652 such as by using the method described in reference to FIGS. 7A-D. As provided in FIG. 6, trigonometry (line x*(tan(alpha)−tan(beta)) can be used to calculate the length of the tool joint that is represented as H. Referring to FIG. 6, the tool joint distance from the rig floor is calculated by the system 600 that will find at least two references, which are the line between pin and the hardbanding on one side and the line between box and wield neck such as those described in FIG. 1. In the illustrated embodiment, the angle, as provided in FIG. 7D, falls between −90 degrees to 90 degrees. In the illustrated embodiment, zero degrees will be observed when the camera's view is parallel to the rig floor.

Figure 7D:
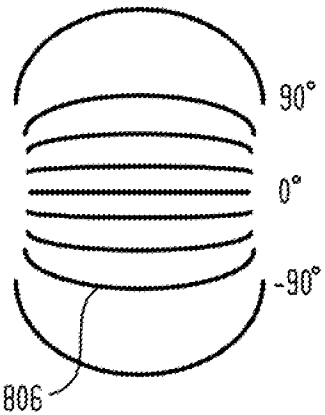
FIGS. 7A, 7B, 7C and 7D are diagrams of curvature of a tool joint.
Figure 7C:
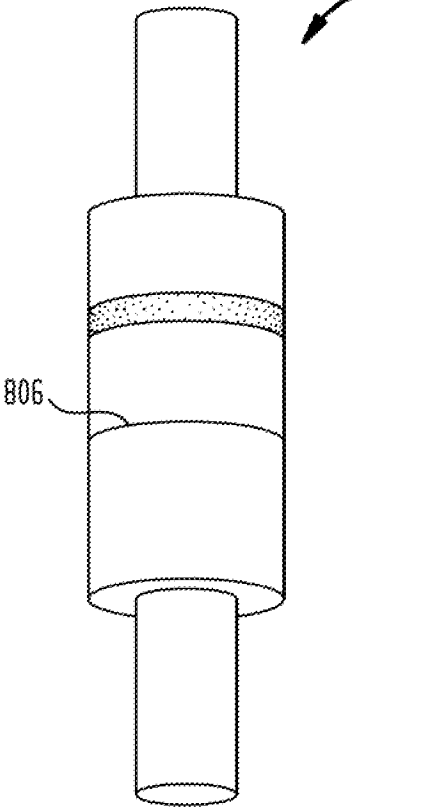
Figure 7B:
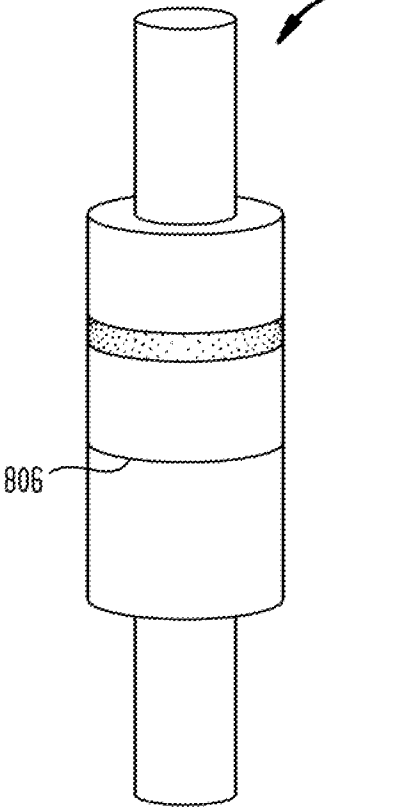
Figure 7A:
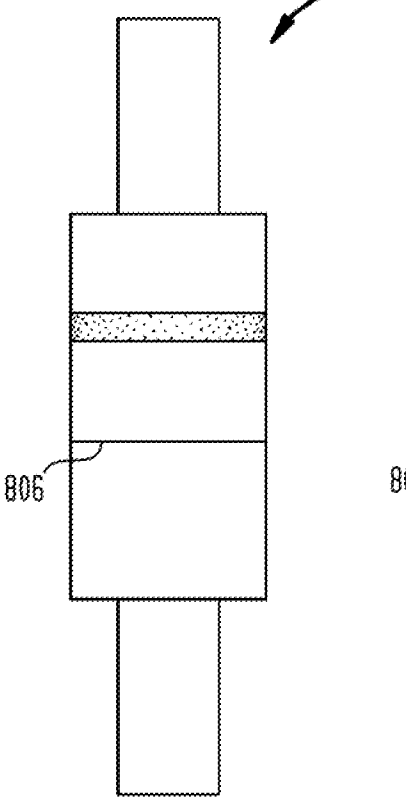

Referring to FIGS. 7A-7D and 8, once the angle, length, diameter, and location of the tool joint 700 is found, the next step is finding the tool joint connection line 806. The diameter may be given to the system or may be visually identified. As illustrated, the perspective of the viewing angle is important for accurately verifying the presence of the tool joint 700. The scanning system in the illustrated embodiment zooms into the tool joint 700 and a separate set of algorithms are started to find the tool joint connection line 806. In the illustrated embodiment, a perspective view of the tool joint 700 is presented at several different angles, a first from zero inclination angle (FIG. 7A), a second from approximately a 20 degree inclination angle (FIG. 7B), a third from approximately a −20 degree inclination angle (FIG. 7C). In FIG. 7D, the tool joint connection line 806 is shown for various levels of inclination from −90 degrees to 90 degrees.

Figure 8:
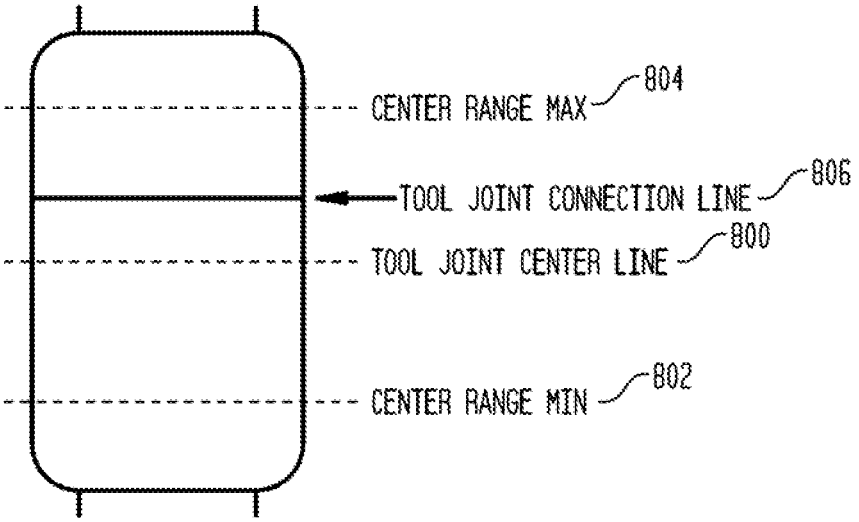
FIG. 8 is a diagram of a center range minimum and maximum used for finding a tool joint connection.

Referring to FIG. 8, in these algorithms, a center range for the possible tool joint connection is calculated. After this calculation, then an image of the "tool joint connection line mean" may be compared to a real time image. In one non-limiting embodiment, a center range is calculated using the tool joint starting line 802 and ending line 804, and averaging these values to determine the center of the tool joint 800. One of the lines is located at the beginning of the pin taper and the other line is located at the end of the box weld neck. After the center of the tool joint is determined, defined as the tool joint center line 800, a predefined length (one example for predefined length may be ⅛ to ¼ of the drill pipe length) is added to the tool joint center line 800 location to create a center range maximum 804. Likewise the predefined length is substracted from the tool joint center line 800 location to create a center range minimum 802. The image representing the center range is compared to the image representing the "tool joint connection line mean". If the system 600 cannot identify the tool joint connection line 806 after a first attempt, the system 600 will recalculate the center range maximum and minimum by increasing the predefined length to develop a larger range. The system 600 will continue to expand the center range, until the tool joint connection line 806 is found.

If the system 600 identifies the tool joint connection line 806, the system 600 stores the information. The system 600 may then identify if there are any grooves on the tool joint, thereby identifying the type of joint. If a groove is identified, the system 600 will store the location of the groove. The system 600 may then determine the gripping location of the tong and the backup tong by using the information stored. After breaking-out the drill pipe the system 600 will go to a stand by mode ready for the next cycle.

Figure 9:
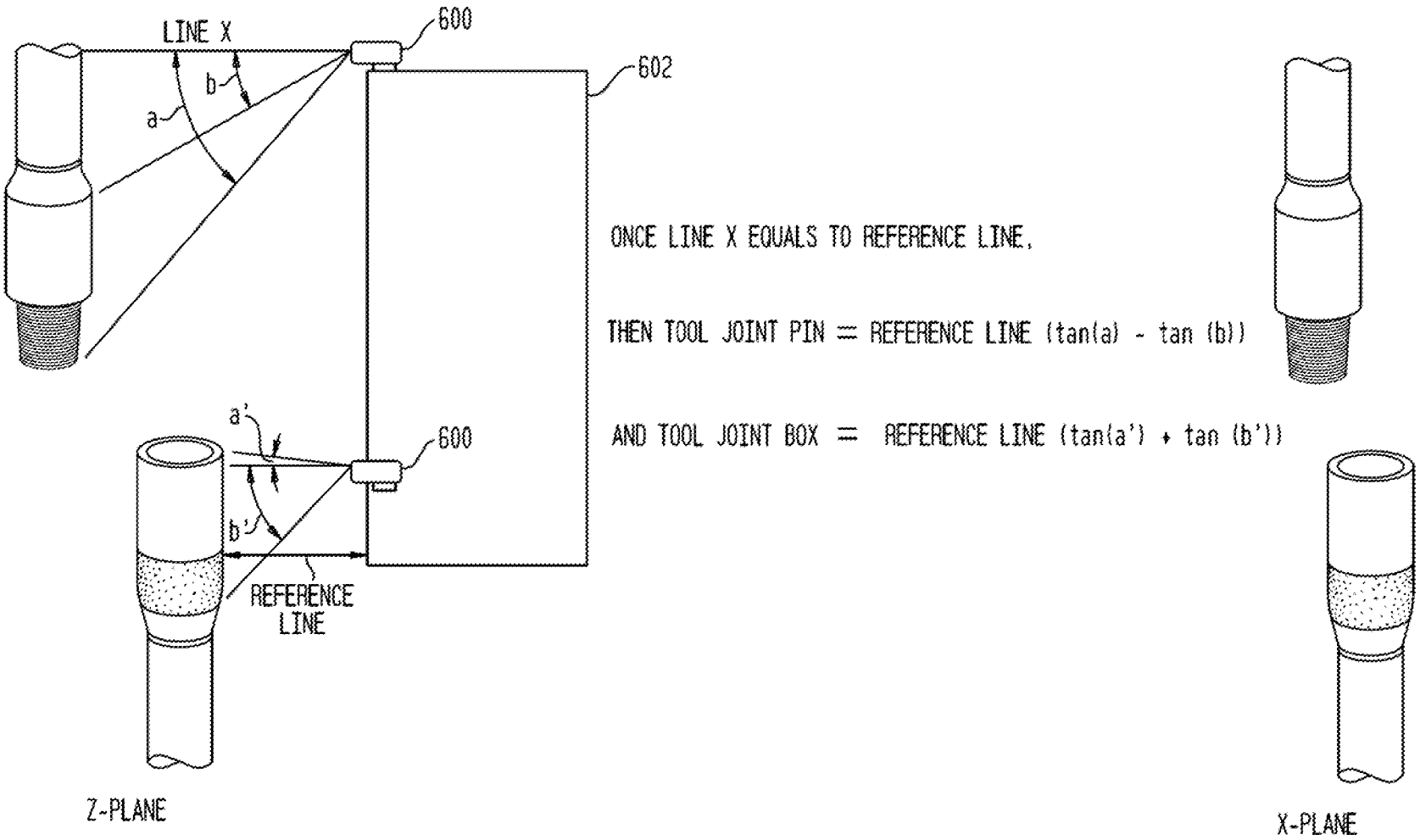
FIG. 9 is a diagram of a z-plane and x-plane views of a tool joint.

Referring to FIG. 9, in another embodiment, the method of making-up drill pipe is similar to the process of breaking-out drill pipe. When the operator commands the system 600 to enter a make-up mode, the system 600 will compare the "tool joint pin mean" image and "tool joint box mean" image to real-time images. In the illustrated embodiment, a scanning system 600 identifies a horizontal distance to the edge of the drill string (line X) as well as angle b to the top of the tool joint and angle a to the end of the pin. In a similar aspect, either a separate scanning system or the same scanning system 600 establishes a reference line to the bottom of the box for the tool joint as well as angles b' and a' as illustrated. Once the system 600 is able to identify the tool joint pin and tool joint box, the system 600 will send out data to the control system to activate distance sensor(s) 1010, provided in FIG. 10. The distance sensor(s) 1010 is/are configured to find a distance of the tool joint pin from the power tong 1022 and the distance of the tool joint box from the back-up tong 1026 while finding the angle of curvature for both the tool joint pin and the tool joint box. The distance sensor may be placed on the power tong 1022 or the power tong frame, as non-limiting examples. The scanning system 600 measurement of the distance to the tool joint box will be the basis (reference) for further measurement since the tool joint box is stationary when the drill pipe is going to be connected. The angle a between the camera and the tool joint pin and the angle between the camera and the tool joint box b' allows determination of the gap (y-axis) between the tool joint pin and the tool joint box.

If the distance between the tool joint pin and the power tong is not the same as the tool joint box and the tong (z-axis of both targets are on the same plane), the tool joint pin and box are required to be aligned. Once there is proper alignment between the tool joint pin and the box, the tool joint pin is lowered into the tool joint box. The system 600 will continue to detect the tool joint pin and tool joint box until the thread of the tool joint pin is within the tool joint box having starting the connection process. The scanning system will send an output to the control system 999 to make-up the drill pipe. While the drill pipe is being made-up (torqued), the scanning system may detect the tool joint for training purposes.

Figure 10:
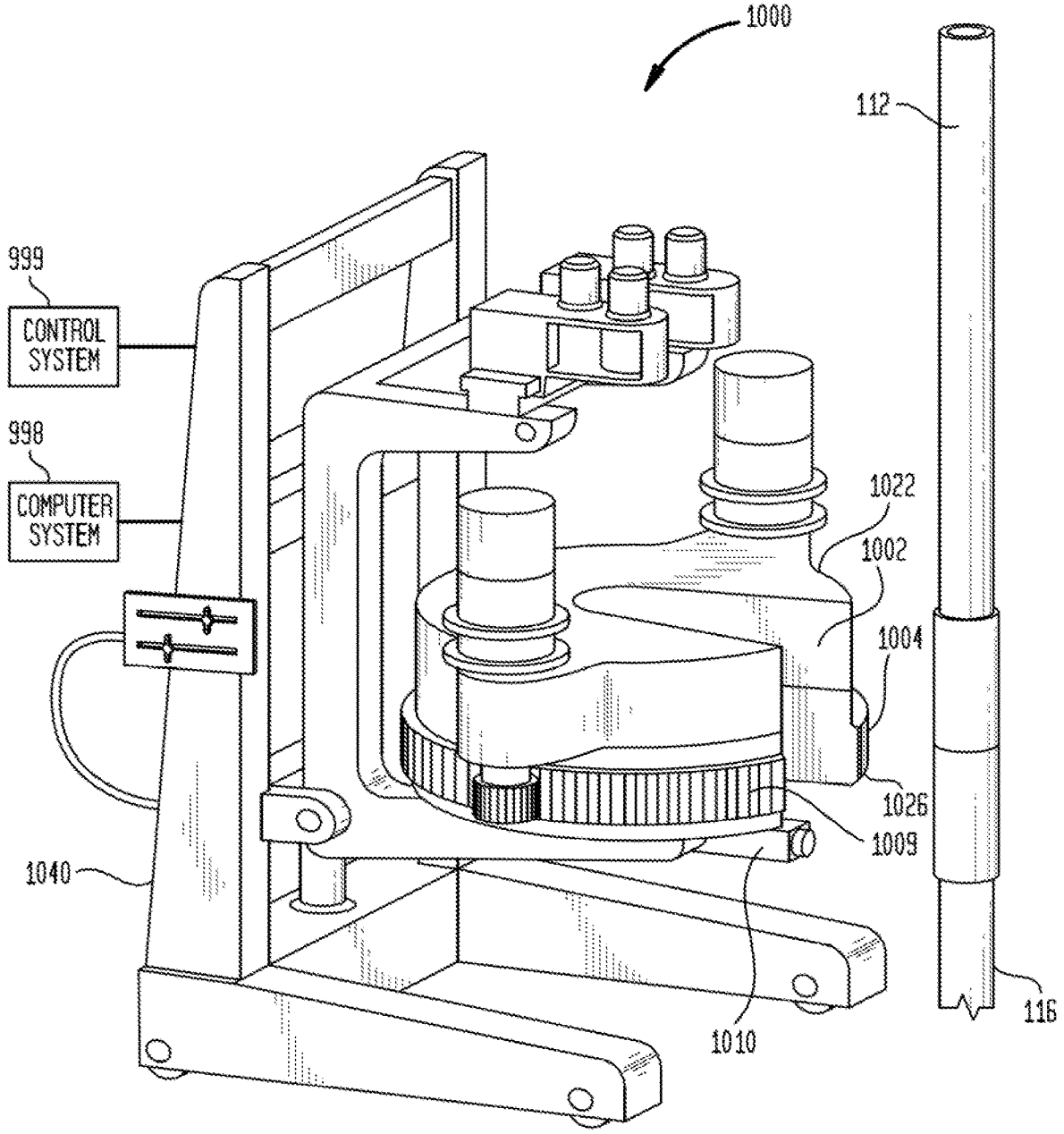
FIG. 10 is a diagram of a system used to determine a tool joint connection.

Referring to FIG. 10, a power tong system 1000 for make-up/break-out of tool joint connections is illustrated. The power tong system 1000 may be connected to a computer 998 that has an output, such as a monitor, for providing data to a user. The computer may be used as a control system 999 for controlling other apparatuses connected to the computer. The power tong system 1000 has a power tong 1022 for turning an upper pipe and a corresponding back-up tong 1026 for holding a lower pipe stationary while the power tong 1022 applies torque to the upper pipe. A set of distance sensors 1010 may be provided on the power tong system 1000 to detect distance between the tool joint and the power tong 1022. The scanning system 600 is also positioned to obtain real-time images so that these images may be compared to mean images through use of the computer. The real-time images may be obtained using, for example, lasers, cameras, ultrasonics, infrared cameras, thermal cameras and/or LIDAR or any combination of these systems. The drill string 116 may be supported in the wellbore using an arrangement of slips 119 that grip and release the drill string 116. A top drive 107 may be used to support the top section of the drill pipe 112 before connection to the drill string 116 or for lifting and removal of the drill pipe 112 once the pipe has been disconnected from the drill string 116. The top drive 107 may be threadedly connected to the drill pipe or may grip the drill pipe using a tubular gripping apparatus. The top drive 107 may also be used for support of the drill pipe removed from the end of the drill string for placement into a pipe rack (not shown) as necessary, for storage. The power tong system 1000 is equipped with a recess 1002 that accepts the drill string 116 and provides a clamping force. Rotation of the drill pipe may be performed by drive gear 1004. As illustrated, the drive gear extends with a periphery to the end 1009 of the recess 1002.

Figure 11:
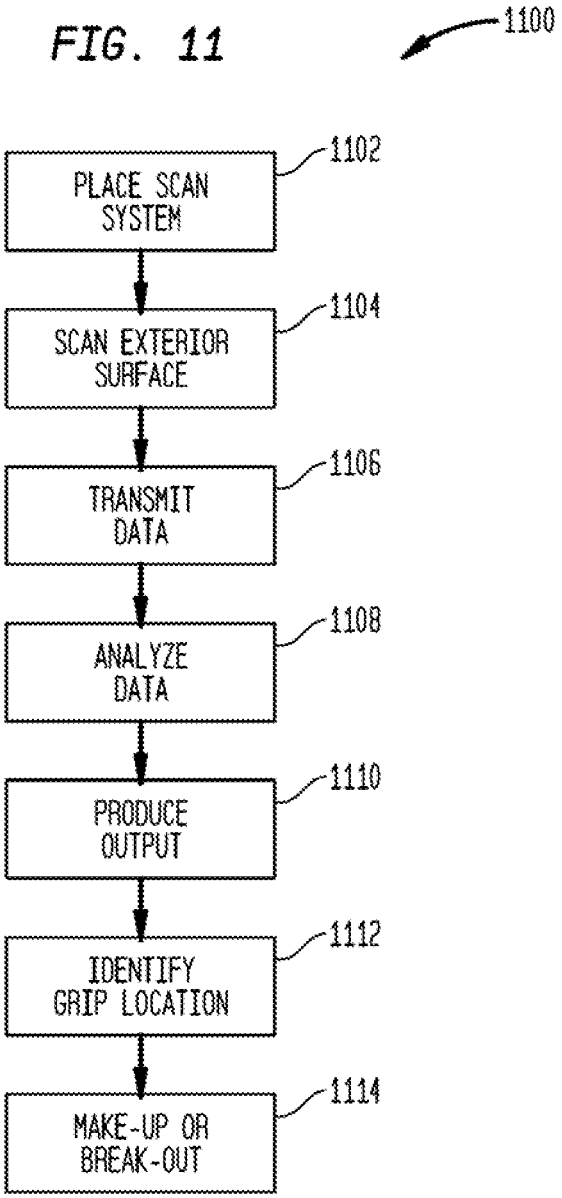
FIG. 11 is a flow chart of a method of one described aspect of the disclosure.

Referring to FIG. 11, a method 1100 for identifying a tool joint connection line is illustrated. At 1102, a scanning system 600 may be positioned near an exterior surface of an object to be analyzed. As discussed above, the object can be a drill string 116, a casing string, or other wellbore tubular strings. The placement of the scanning system 600 may be performed by a movable platform 603 supporting the scanning system 600. Platform 603 may be automated, mechanized, and/or manually operated. At 1104, the exterior of the object to be analyzed (drill string 116 or casing) may be scanned, producing a set of data that is to be analyzed. The scanning may be, for example, through use of a camera of the system 600. At 1106, the data to be analyzed may be transmitted to a computer in a wireless transmission or a wired transmission. The data is received at the computer and then analyzed to determine the presence of a tool joint. In a non-limiting embodiment, the top and bottom of a tool joint may be identified through the scan. The data may be analyzed at 1108 to indicate the presence of a tool joint connection. The presence of a tool joint connection may be determined through calculating an average center line of where the top and bottom of the tool joint may be located and then averaging the two distances to produce a mean center line of the tool joint connection line. Further analysis may be conducted to determine the presence of the tool joint connection line and an output is produced at 1110.

At 1112, grip locations, which may be the areas of hardbanding, may be determined for power actuated devices to allow the tool joint to be made-up or broken-out. In a non-limiting embodiment, the power actuated devices may be power tongs and back-up tongs. After engagement of the power actuated devices on the exterior of the drill string 116 or casing, the power actuated devices may be actuated to make-up or break-out the drill string or casing, as necessary 1114.

In one non-limiting embodiment, a method for identifying a feature of a drill string is disclosed comprising placing a scanning system along the drill string, the scanning system having at least one arrangement configured to scan the drill string, scanning an exterior of the drill string with the scanning system to obtain scan data, transmitting the scan data to a computer, analyzing the scan data with the computer by comparing the scan data with a training data set and producing an output from the computer to a user indicating where a tool joint location in the drill string is present.

In another non-limiting embodiment, the method may further comprise placing the scanning system in one of a standby mode, a make-up mode and a breakout mode.

In still further non-limiting embodiment, the method may be performed wherein the analyzing compares a mean image to the scan data.

In another non-limiting embodiment, the method may further comprise obtaining a second set of data by scanning the exterior of the drill string.

In another non-limiting embodiment, the method may further comprise identifying a tool joint connection.

In another non-limiting embodiment, the method may be performed wherein the identifying the tool joint connection involves identifying an angle, a length and a diameter of the tool joint.

In another non-limiting embodiment, the method may further comprise calculating a tool joint connection line mean image.

In another non-limiting embodiment, the method may be performed wherein the scanning system is one of a laser, an infrared laser, an infrared camera, a thermal camera and LIDAR.

In another non-limiting embodiment, the method may further comprise identifying a groove of the tool joint.

In a still further embodiment, the method may further comprise identifying gripping locations of a tong and a back-up tong to accomplish an untorquing of the tool joint.

In another non-limiting embodiment, the method may further comprise placing a tong and the back-up tong on the identified gripping locations and untorquing the tool joint.

In a still further embodiment, an apparatus for identifying a tool joint connection is disclosed comprising a scanning system configured to scan an exterior of a drill string, at least one distance measuring sensor mounted to a movable platform and a computer connected to the scanning system and the at least one distance measuring sensor, wherein the computer is configured to receive data from a scanning of the exterior of the drill string and compare the data from the scanning to a reference to determine a presence of the tool joint connection.

In another non-limiting embodiment, the apparatus may further comprise a slips arrangement configured to hold the drill string at an elevation.

In a still further non-limiting embodiment, the apparatus may further comprise one of a top drive and a casing running tool configured to hold and move a pipe.

In another non-limiting embodiment, the apparatus may further comprise a power tong and a back-up tong, wherein the tongs are configured to hold an exterior of the drill string.

In another non-limiting embodiment, the apparatus may be configured wherein the distance measuring sensor is connected to at least one of the power tong and the back-up tong.

In another non-limiting embodiment, the apparatus may further comprise an output device for the computer, wherein the output device is one of a display and a printer.

While embodiments have been described herein, those skilled in the art, having benefit of this disclosure will appreciate that other embodiments are envisioned that do not depart from the inventive scope of the present application. Accordingly, the scope of the present claims or any subsequent related claims shall not be unduly limited by the description of the embodiments described herein.

What is claimed is:

1. A method for identifying a tool joint, comprising:

positioning a scanning system adjacent a pipe string, the scanning system having at least one sensor configured to scan the pipe string;

scanning the pipe string using the scanning system to obtain scan data;

transmitting the scan data to a computer;

analyzing the scan data using the computer by comparing the scan data with a training data set to determine whether the scan data includes an image of a tool joint;

when the scan data is determined to include the image of the tool joint, determining, using the computer:

a location of a top portion and a location of a bottom portion of the tool joint based at least on a first angle of a first line between the sensor and the top portion of the tool joint with respect to horizontal and a second angle of a second line between the sensor and the bottom portion of the tool joint with respect to horizontal, and a tool joint connection line in the tool joint based at least on a tool joint center line between the top portion of the tool joint and the bottom portion of the tool joint;

identifying a groove formed on one of the top portion and the bottom portion, the groove being separate from the tool joint connection line;

based on the identified groove and the determined tool joint connection line, identifying gripping locations of a tong and a back-up tong to accomplish an untorquing of the tool joint; and receiving an output from the computer indicating a location of the tool joint in the pipe string and the identified gripping locations.

2. The method according to claim 1, further comprising:

putting the scanning system in one of a standby mode, a make-up mode and a break-out mode.

3. The method according to claim 1, wherein the analyzing compares a mean image to the scan data.

4. The method according to claim 1, further comprising obtaining a second set of data by scanning the exterior of the pipe string.

5. The method according to claim 1, further comprising:

calculating a tool joint connection line mean image.

6. The method according to claim 1, wherein the scanning system is one of a laser, an infrared laser, an infrared camera, a thermal camera and LIDAR.

7. The method according to claim 1, further comprising:

placing the tong and the back-up tong on the identified gripping locations; and untorquing the tool joint.

8. An apparatus for identifying a tool joint connection, comprising:

a scanning system configured to scan an exterior of a pipe string;

at least one distance measuring sensor mounted to a movable platform; and a computer connected to the scanning system and the at least one distance measuring sensor, wherein the computer is configured to:

receive data from a scanning of the exterior of the pipe string and compare the data from the scanning to reference data to determine a presence of a tool joint, when the tool joint is determined to be present, determine a location of a tool joint connection line in the tool joint based at least on:

a distance to the pipe string measured by the at least one distance measuring sensor, and a first angle of a first line between the scanning system and a top portion of the tool joint with respect to horizontal and a second angle of a second line between the scanning system and a bottom portion of the tool joint with respect to horizontal, identify a groove formed on one of the top portion and the bottom portion, the groove being separate from the tool joint connection line, based on the identified groove and the determined location of the tool joint connection line, identifying gripping locations of a power tong and a back-up tong to accomplish an untorquing of the tool joint, and output the determined location of the tool joint connection line in the pipe string and the identified gripping locations.

9. The apparatus according to claim 8, further comprising:

a slip arrangement configured to hold the pipe string at an elevation.

10. The apparatus according to claim 8, further comprising:

one of a top drive and a casing running tool configured to hold and move the pipe string.

11. The apparatus according to claim 8, wherein the power tong and back-up tong are configured to hold an exterior of the pipe string.

12. The apparatus according to claim 11, wherein the at least one distance measuring sensor is connected to at least one of the power tong and the back-up tong.

13. The apparatus according to claim 8, further comprising:

an output device for the computer, wherein the output device is one of a display and a printer.

14. A method for identifying a tool joint, comprising:

positioning a scanning system adjacent a pipe string, the scanning system having at least one sensor configured to scan the pipe string;

scanning the pipe string using the scanning system to obtain scan data;

transmitting the scan data to a computer;

analyzing the scan data using the computer by comparing the scan data with a training data set to determine whether the scan data includes an image of a tool joint; and when the scan data is determined to include the image of the tool joint:

identifying, using the computer, a groove formed on the tool joint, the groove being separate from a tool joint connection line of the tool joint, and based on the identified groove, identifying, using the computer, gripping locations of a tong and a back-up tong to accomplish an untorquing of the tool joint.

15. The method according to claim 14, further comprising:

when the scan data is determined to include the image of the tool joint, identifying, using the computer:

a top portion and a bottom portion of the tool joint based at least on a first angle of a first line between the sensor and the top portion of the tool joint with respect to horizontal and a second angle of a second line between the sensor and the bottom portion of the tool joint with respect to horizontal, and the tool joint connection line in the tool joint based at least on a tool joint center line between the top portion of the tool joint and the bottom portion of the tool joint; and receiving an output from the computer indicating the determined location of the tool joint in the pipe string.

16. The method according to claim 14, further comprising:

identifying a diameter of the tool joint.

17. The method according to claim 14, wherein the training data set includes data sets of each of: tool joints, tool joint boxes, tool joint pins, tool joint connection lines.

18. The method according to claim 17, wherein the method step of analyzing the scan data by comparing the scan data with the training data set further comprises determining whether the scan data includes the image of any one of the tool joints, tool joint boxes, tool joint pins, and tool joint connection lines.

* * * * *